US005456360A

United States Patent [19]

Griffin

[11] Patent Number: 5,456,360

[45] Date of Patent: Oct. 10, 1995

[54] HOLDER ASSEMBLY FOR REACTION TUBES

[75] Inventor: Reginald Griffin, Wrentham, Mass.

[73] Assignee: The Perkin-Elmer Corporation, Norwalk, Conn.

[21] Appl. No.: 316,299

[22] Filed: Sep. 30, 1994

[51] Int. Cl.[6] ..... B65D 85/20; B65D 85/62; B65D 21/00

[52] U.S. Cl. ..... 206/443; 206/446; 206/503; 206/514; 206/515; 220/23.86

[58] Field of Search ..... 206/503, 510, 206/514, 515, 518, 443, 446; 220/23.83, 23.86, 761

[56] References Cited

U.S. PATENT DOCUMENTS

| | | | |
|---|---|---|---|
| 2,684,766 | 7/1954 | Blom | 206/503 X |
| 3,643,812 | 2/1972 | Monder et al. | 206/446 X |
| 3,695,424 | 10/1972 | Cristy et al. | 220/23.83 X |
| 4,227,642 | 10/1980 | Ortel | 206/503 X |
| 4,895,256 | 1/1990 | Johnston | 206/501 |
| 5,038,852 | 8/1991 | Johnson et al. | 165/12 |
| 5,080,232 | 1/1992 | Leoncavallo et al. | 206/446 |
| 5,282,543 | 2/1994 | Picozza et al. | 220/255 |
| 5,366,888 | 10/1994 | Hill et al. | 206/443 X |

FOREIGN PATENT DOCUMENTS 250674 1/1988 European Pat. Off. .

91311090.4 11/1991 European Pat. Off. .

*Primary Examiner*—Paul T. Sewell
*Assistant Examiner*—Tara L. Laster
*Attorney, Agent, or Firm*—Edwin T. Grimes

[57] ABSTRACT

This invention is directed to a plastic holder assembly for loosely holding a plurality of microtiter sample tubes, which includes a tray having a plurality of holes for receiving the tubes and having opposite vertical end walls, each of which have two spaced vertically extending slots and a horizontally extending recess between the slots; a retainer releasably nestable in the tray having a corresponding plurality of holes and having opposite vertical end walls corresponding to the end walls of the tray; a U-shaped handle extending horizontally outwardly from each of the opposite retainer end walls, each handle having two legs which slide into the tray slots respectively when the retainer is nested in the tray; a tab projecting horizontally outwardly from each of the retainer end walls between each of the two legs which snap into the tray end wall recesses respectively when the retainer is nested in the tray, the retainer having an elongated slot parallel and directly adjacent each of the end walls, whereby inwardly directed finger pressure on the U-shaped handles inwardly flex the opposite ends of the retainer to release the tabs from the tray recesses respectively to facilitate removal of the retainer from the tray.

20 Claims, 5 Drawing Sheets

HOLDER ASSEMBLY FOR REACTION TUBES

FIELD OF INVENTION

This invention generally relates to a holder assembly for holding reaction tubes, preferably utilized in an instrument for automated thermal cyclers for performing polymerase chain reactions (PCR).

BACKGROUND OF THE INVENTION

Automated thermal cyclers for performing PCR simultaneously on a number of samples are disclosed in U.S. Pat. No. 5,038,852. Briefly, PCR is an enzymatic process by which a small amount of specific DNA sequences can be greatly amplified in a relatively short period of time. The method utilizes two oligonucleotide primers that hybridize to opposite strands and flank the region of interest in the target DNA. A repetitive series of thermal cycles involving template denaturation, primer annealing, and the extension of the annealed primers by DNA polymerase results in the exponential accumulation of a specific DNA fragment whose termini are defined by the 5' ends of the primers.

A reaction mixture made up of the target DNA to be amplified, oligonucleotide primers, buffers, nucleotide triphosphates, and preferably a thermostable enzyme such as Taq polymerase, are combined and placed in reaction tubes. The reaction mixture contained in the tubes is then subjected to a number of thermal transition and soak periods known as PCR protocols in a thermal cycler to generate the amplified target DNA.

An array of reaction tubes is typically made up of up to either twenty four or forty eight or ninety six tubes arranged in a 8×3 array or a 6×8 array or an 8×12 array in a tray. The array of tubes is placed in a metal thermal cycler block so that the lower portion of each tube is in intimate thermal contact with the block.

The temperature of the block is then varied in accordance with the predetermined temperature/time profile of the PCR protocol for a predetermined number of cycles.

Holder assemblies for reaction tubes are preferably compatible with microtiter plate format lab equipment while maintaining sufficient individual tube freedom of movement to compensate for differences in the various rates of thermal expansion of the various components.

SUMMARY OF THE INVENTION

Briefly, this invention contemplates the provision of a new and improved plastic holder assembly for loosely holding a plurality of microtiter sample tubes, which includes a tray having a plurality of holes for receiving the tubes. The tray has opposite vertical end walls, each of the end walls having two spaced vertically extending slots and a horizontally extending recess therebetween. A retainer is provided which releasably nests in the tray. The retainer has a corresponding plurality of holes, and has opposite vertical end walls corresponding to the end walls of the tray. A U-shaped handle extends horizontally outwardly from each of the opposite retainer end walls. Each of the handles have two legs which slide into the tray slots respectively when the retainer is nested in the tray. A tab projects horizontally outwardly from each of the retainer end walls between the legs, which snap into the tray end wall recesses respectively when the retainer is nested in the tray. The retainer has an elongated slot parallel and directly adjacent each of the end walls, whereby inwardly directed finger pressure on the U-shaped handles inwardly flexes the opposite ends of the retainer to release the tabs from the tray recesses respectively to facilitate removal of the retainer from the tray.

According to one aspect of the invention, a plastic base is provided, which has a plurality of wells in a rectangular array, compatible with the holes in the tray and retainer. The wells are dimensioned to snugly accept the lower sections of the tubes. The base is assembled with the tray and retainer and sample tubes to form a microtiter plate assembly having a foot print of a industry standard microtiter plate assembly.

In one form of the invention the tray and retainer have beveled mating corners, thereby to align the retainer with respect to the tray repeatedly in the same orientation.

According to another aspect of the invention, the assembly is fabricated from molded reinforced polyester thermoplastic with the wall sections having a thickness of the order of about 1.27 mm.

These, and other advantages and features of the invention, will become more apparent from a detailed reading of the following description when taken in conjunction with the appended claims.

DETAILED DESCRIPTION OF THE PRESENTLY PREFERRED EMBODIMENT OF THE INVENTION

Figure 1:
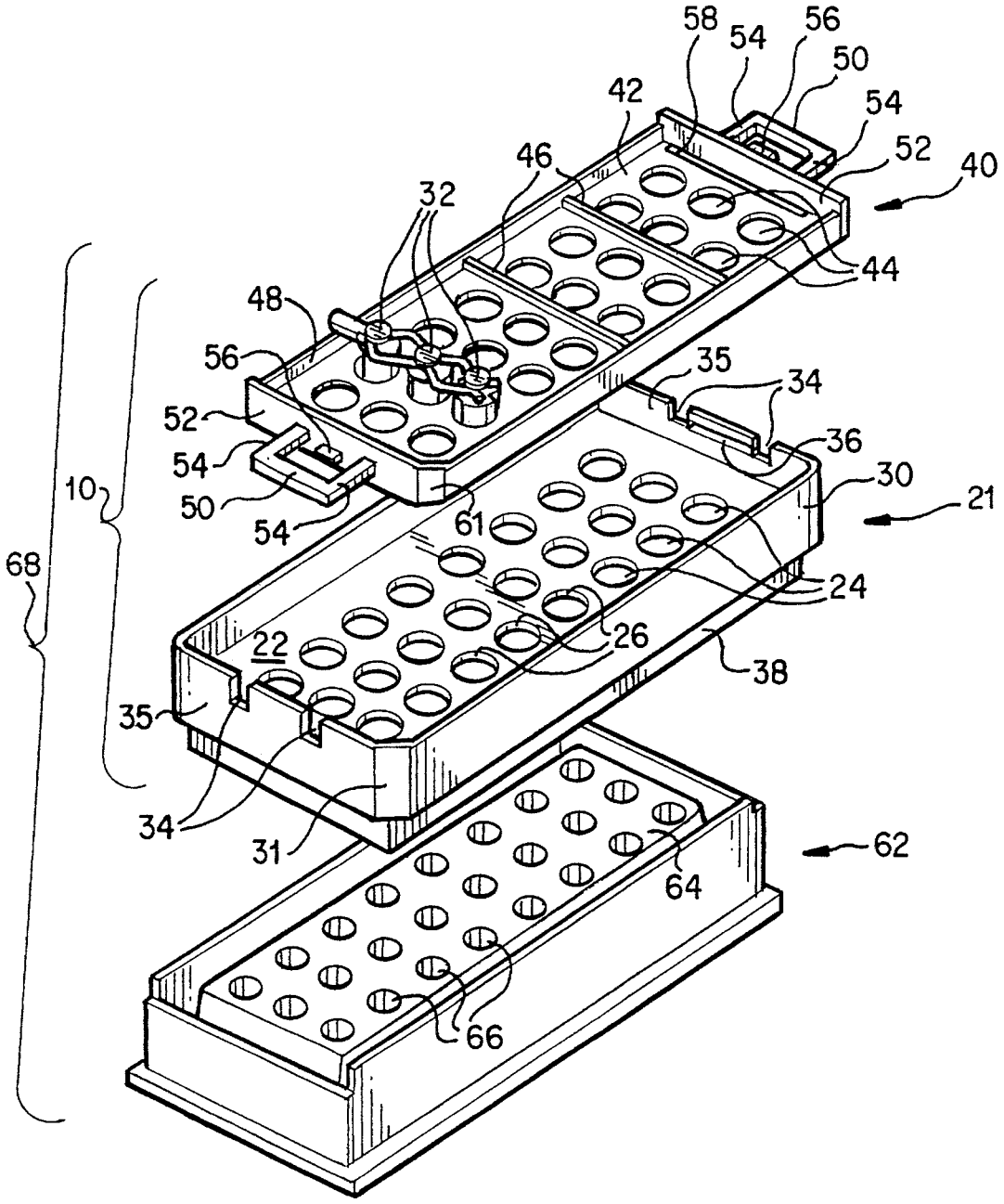
FIG. 1 is an exploded perspective view of a microtiter plate assembly, including the plastic holder assembly according to the invention.
Figure 2:
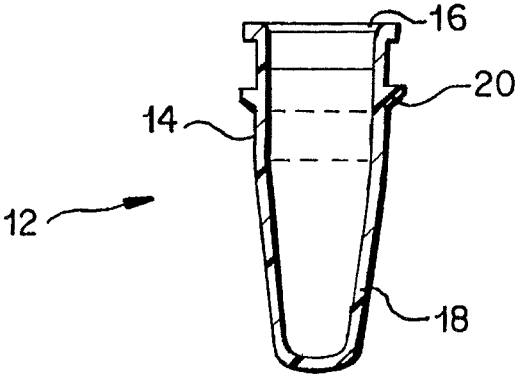
FIG. 2 is a vertical sectional view of a sample tube.

FIG. 1 is an exploded perspective view of a presently preferred embodiment of the invention. A two piece plastic holder assembly, indicated at 10, loosely holds a plurality of microtiter sample tubes indicated at 12, FIG. 2. Each tube has a cylindrical shaped upper section 14 open at its top end 16 and a closed, tapered lower section 18 extending downwardly therefrom. Each tube is of circular cross-section and has a circumferential shoulder 20 extending outwardly from the upper section 14 at a position on the upper section spaced from the open end 16 thereof.

Figure 5:
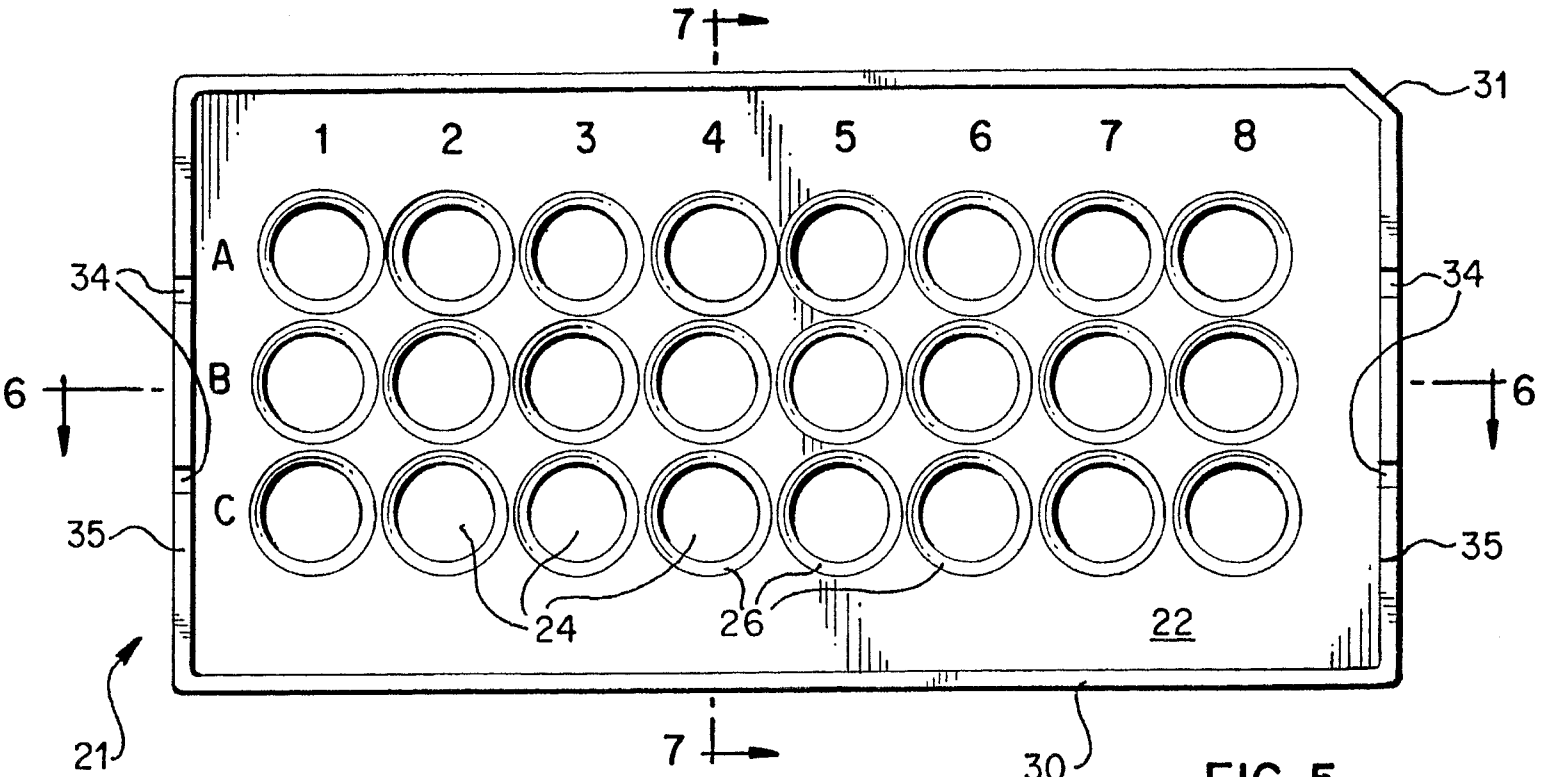
FIG. 5 is a top plan view of the tray.
Figure 6:
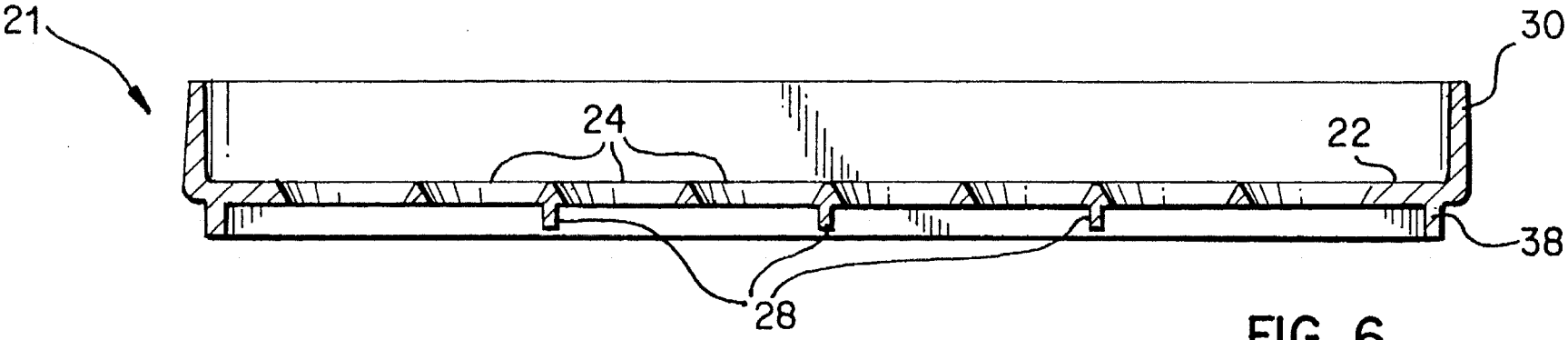
FIG. 6 is a sectional view taken through the tray along section line 6—6 in FIG. 5.

A one-piece tray 21, as seen in FIGS. 1, 5, 6 and 7, comprises a flat, horizontal, rectangular tray plate section 22, which contains a first plurality of holes 24 in an array compatible with industrial standard microtiter plate format. FIGS. 1 and 5 show an array of 24 holes. However, in some installations it may be desirable to have other numbers of holes such as, for example, forty eight or ninety six. The diameters of the holes are larger than the outside diameter of the upper section 14 of the tubes 12, FIG. 2, by about 0.7 mm., but are smaller than the outside diameter of the shoulder 20. The holes are counter-sunk as indicated at 26 in FIGS. 1 and 5. The tray plate 22 has a plurality of support ribs 28, as best seen in FIG. 6, between the rows of holes. Three ribs are shown in FIG. 6.

Figure 7:
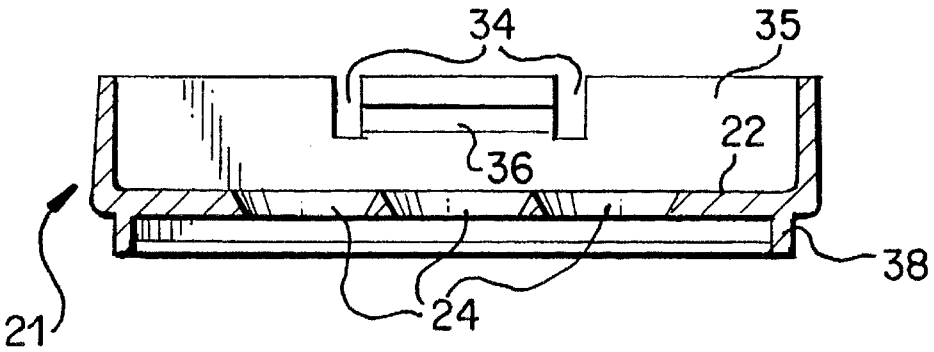
FIG. 7 is a sectional view taken through the tray along section line 7—7 in FIG. 5.

The tray 21 further includes a vertical tray sidewall section 30 around the plate section 22 extending upwardly to a height greater than the height of a tube 32, FIG. 1, resting in one of the holes 24. Two spaced vertically extending tray sidewall slots 34, FIGS. 1, 5 and 7 are disposed in each of two opposite ends 35 of the tray sidewall section 30. An elongated horizontal tray sidewall recess 36 is disposed between each of the two-spaced tray sidewall slots for a purpose two be discussed more fully hereinafter.

The tray 21 also includes a second vertical tray sidewall section 38, FIGS. 1, 6 and 7, around the plate section 22 extending downwardly approximately to the bottom of the upper section 14 of a tube 12 resting in one of the holes 24.

Figure 3:
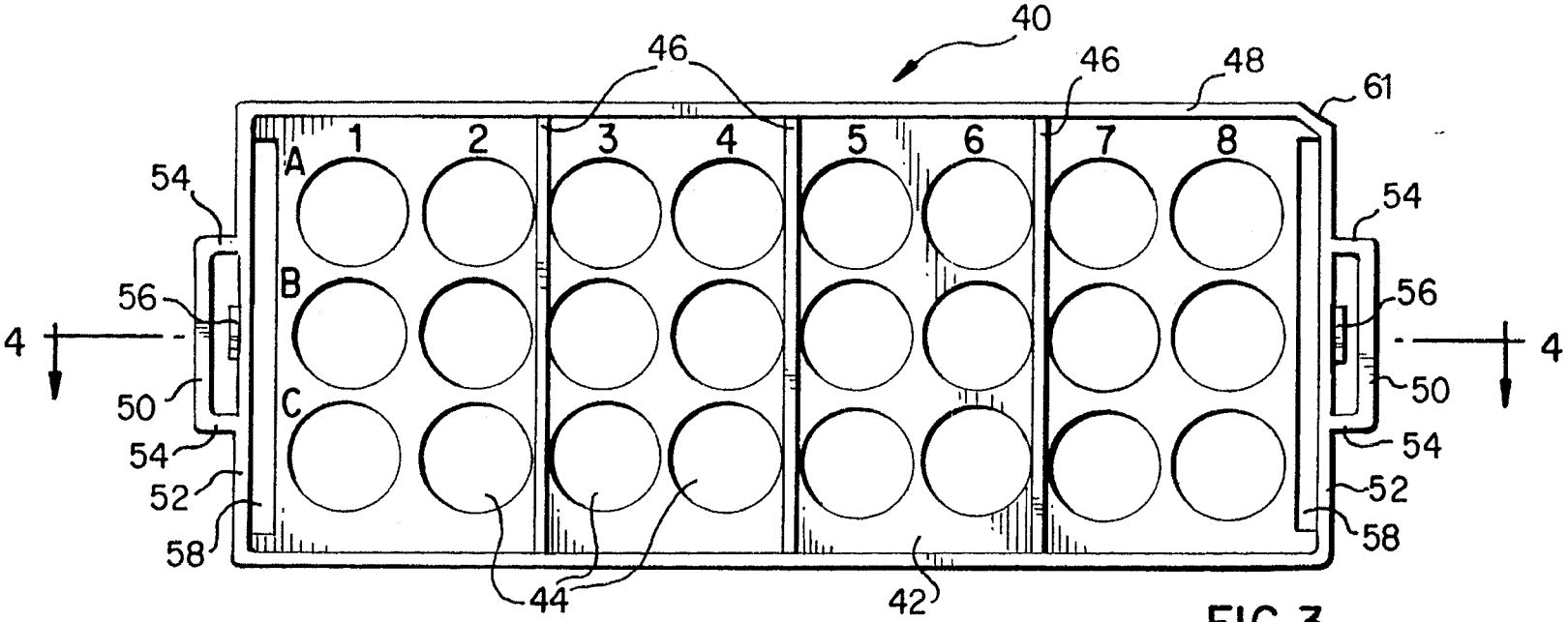
FIG. 3 is a top plan view of the retainer.
Figure 4:
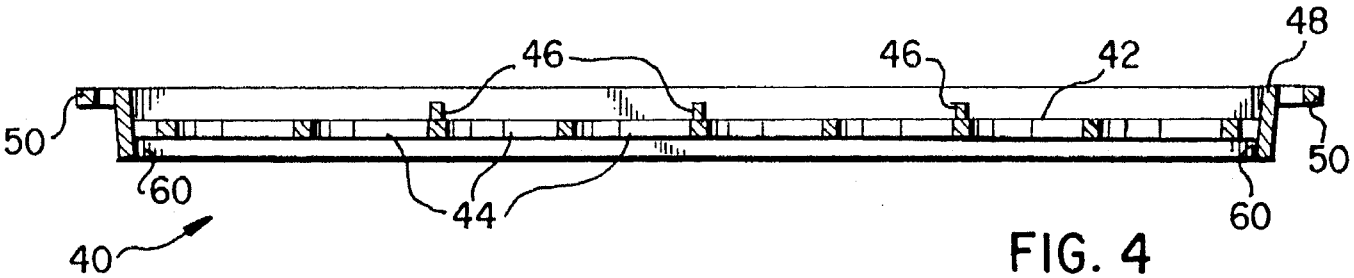
FIG. 4 is a sectional view taken through the retainer along section line 4—4 in FIG. 3.

A one-piece rectangular retainer 40, as seen in FIGS. 1, 3 and 4 is releasably nested in the tray 21 over the sample tubes 32 resting in the tray. This retainer includes a flat, horizontal, rectangular plate section 42, which contains a second plurality of holes 44 in a rectangular array compatible with the first plurality of holes 24. That is, the holes 44 are in vertical alignment with the holes 24 when the retainer 40 is nested in the tray 21. Twenty-four holes are shown, for example. As indicated hereinbefore, this array of holes is compatible with industrial standard microtiter plate format. Holes 44 are larger in diameter than the outside diameter of the upper portion 14 of the tube 12 by about 0.7 mm., but smaller than the outside diameter of the shoulder 20. This retainer plate section 42 has a plurality of support ribs 46 extending along the upper side of the retainer plate section between the rows of holes.

The retainer 40 has a first vertical retainer sidewall section 48 extending around the plate section 42 and which extends upwardly. A U-shaped handle 50, FIGS. 1, 3, and 4, extends horizontally outwardly from each of two opposite ends 52 of the retainer sidewall section 48 corresponding to the two opposite ends 35 of the tray sidewall section 30. Each of the U-shaped handles 50 has two spaced legs 54, which slide into the tray slots 34 respectively, when the retainer 40 is nested in the tray 21. Tabs 56 project horizontally outwardly from the sidewall sections 52 respectively between each of the two legs 54. These tabs 56 snap into the sidewall recess 36 in the sidewall sections 35 of the tray 21 respectively when the retainer 40 is nested in the tray 21. The retainer plate section 42 has elongated slots 58, FIGS. 1 and 3, parallel to and directly adjacent the opposite ends 52 of the retainer sidewall section respectively, whereby inwardly directed finger pressure on the U-shaped handles 50 inwardly flex the opposite ends 52 of the retainer sidewall sections to release the tabs 56 from the tray sidewall recesses 36 respectively, thereby to facilitate removal of the retainer 40 from the tray 21.

In addition, the retainer 40 has a second vertical retainer sidewall section 60, FIG. 4, extending around the retainer plate section 42 and extending downwardly from the retainer plate section.

The tray 21 of FIGS. 5–7, with up to twenty-four sample tubes 12 placed therein and with the retainer 40 snapped into position, forms a single unit 10, which can be placed in a PCR instrument for processing. When the retainer 40 is nested in the tray 21, the retainer plate section 42 lies slightly above the shoulder 20, FIG. 2, of a tube resting in the tray and the first tray sidewall section 30 is about as high as the retainer sidewall section 48, whereby tubes resting in the tray are retained loosely both vertically and laterally.

The first vertical tray sidewall section 30 has a beveled corner 31, FIGS. 1 and 5, and the vertical retainer sidewall sections 48 and 60 have mating beveled corners 61, FIGS. 1 and 3, thereby to align the retainer with the tray repeatedly in the same orientation.

Figure 8:
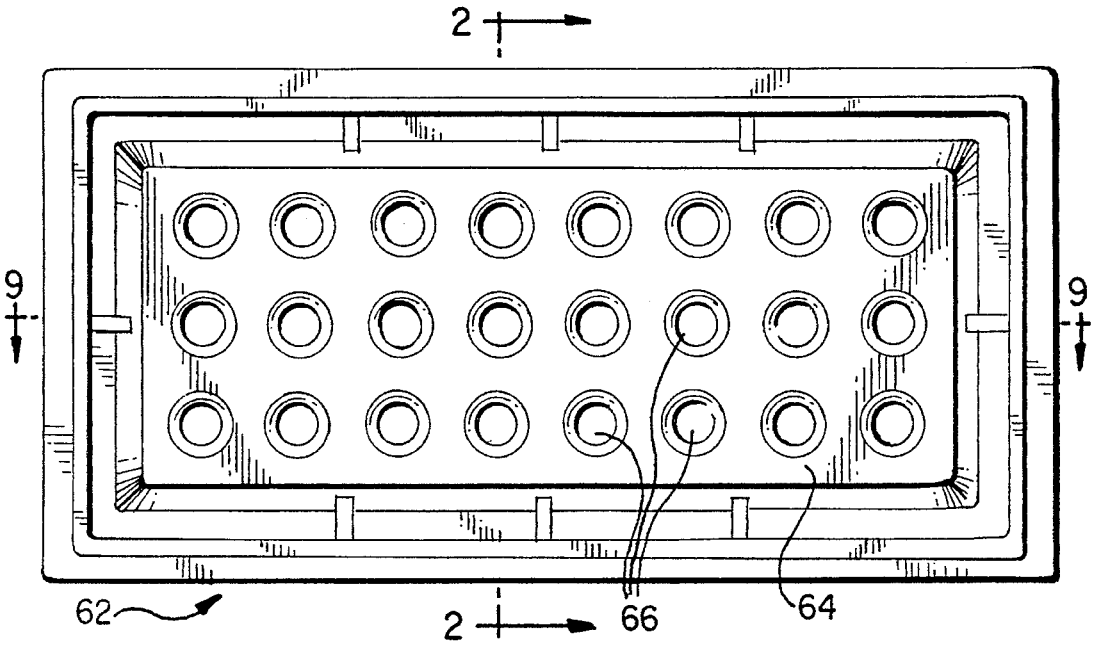
FIG. 8 is a top plan view of the base.
Figure 9:
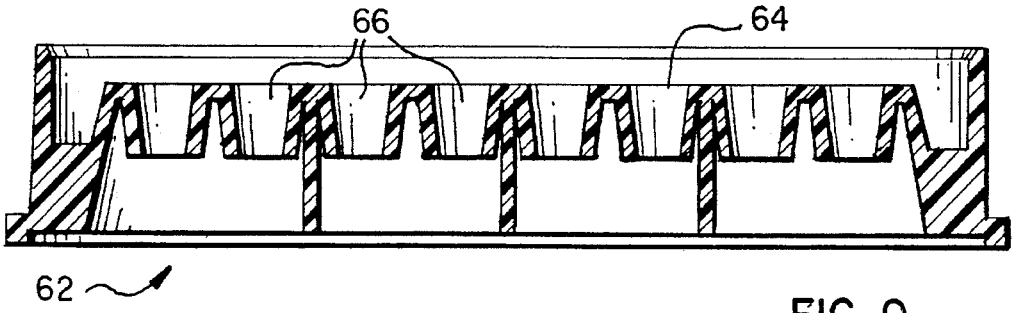
FIG. 9 is sectional view taken along the line 9—9 in FIG. 8.
Figure 10:
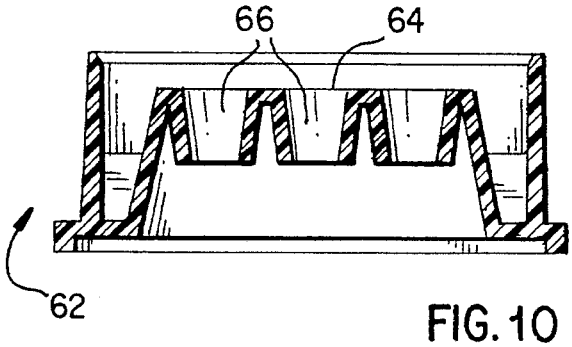
FIG. 10 is a sectional view taken along the line 10—10 in FIG. 8.

After processing, all of the tubes, such as those indicated at FIG. 1, they may be removed simultaneously by lifting the tray out of the PCR instrument. For convenience and storage, the tray 21 with the sample tubes and the retainer 40 in place can be inserted into another plastic component called a base 62, FIG. The base 62 is assembled with the tray 21 and the retainer 40 and the sample tubes 32 to form a microtiter plate assembly 68 having a footprint of an industry standard microtiter plate assembly. That is, the base has the outside dimensions and footprint of a standard 24-well microtiter plate as is shown in FIGS. 1, 8, 9 and 10. FIG. 8 is a top plan view of the base 62, while FIG. 9 is a sectional view taken along the line 9—9 in FIG. 8. FIG. 10 is a sectional view taken through the base along section line 10—10 in FIG. 8. The base 62 includes a flat plate section 64 in which an array of twenty four wells 66 with sloped edges is formed. These wells have dimensions and spacing such that when the tray 21 is nested in the base 62, the holes 44, 24 and wells 66 are in vertical alignment, and the bottoms of the sample tubes 32 are held in the same relationship to the tray 21 as the sample tubes are held when the frame is mounted in the PCR instrument. The individual sample tubes, though loosely captured between the tray and the retainer, become firmly seated and immobile when the tray is inserted in the base. That is, when the tray 21, sample tubes 32, and retainer 40 are seated in the base 62, the entire assembly becomes the exact functional equivalent of an industry standard 24-well, for example, microtiter plate, and can be placed in virtually any automatic pipetting or sampling system for a 24-well industry microtiter plates for further processing.

The aforementioned sections of the tray 21 and retainer 40 are preferably molded from reinforced polyester thermoplastic or the equivalent and the sections have a thickness of the order of about 1.27 mm.

It will thus be seen that the present invention does indeed provide a new and improved microtiter plate assembly that is easy to assembly and disassemble and yet gives each sample tube sufficient freedom of motion in all necessary directions to compensate for differing rates of thermal expansion and yet retains them in an array that is compatible with industry standard microtiter plate format.

Although certain particular embodiments of the invention are herein disclosed for purposes of explanation, further modifications thereof, after study of this specification, will be apparent to those skilled in the art to which the invention pertains. Reference should accordingly be had to the appended claims in determining the scope of the invention.

What is claimed is:

1. A plastic holder assembly for loosely holding a plurality of microtiter sample tubes comprising a tray having a plurality of holes for receiving the sample tubes, said tray having opposite vertical end walls, each of said tray end walls having two spaced vertically extending slots and a horizontally extending recess between the slots, a retainer releasably nestable in said tray having a plurality of holes corresponding to the plurality of holes in said tray for receiving the sample tubes, said retainer having opposite vertical end walls corresponding to the end walls of said tray, a U-shaped handle extending horizontally outwardly from each of said opposite retainer end walls, each of said handles having two legs which slide into said tray slots respectively when said retainer is nested in said tray, a tab projecting horizontally outwardly from each of the retainer end walls between each of said two legs which snap into said tray end wall recesses respectively when said retainer is nested in said tray, said retainer having an elongated slot parallel and directly adjacent each of said end walls, whereby inwardly directed finger pressure on said U-shaped handle inwardly flexes said opposite ends of said retainer to release said tabs from said tray recesses respectively to facilitate removal of said retainer from said tray.

2. Apparatus according to claim 1 further comprising a plastic base having a plurality of wells in a rectangular array compatible with said plurality of holes in said retainer and in said tray, said walls being dimensioned to snugly accept lower sections of said tubes, said base being nestable with said tray, said retainer and said sample tubes to form a microtiter plate assembly having a footprint of an industry standard microtiter plate assembly.

3. Apparatus according to claim 1 wherein said holder assembly is molded from reinforced polyester thermal plastic.

4. Apparatus according to claim 1 wherein the wall thickness of said holder assembly is of the order of about 1.27 mm.

5. Apparatus according to claim 1 wherein said tray and said retainer have mating beveled corners, thereby to repeatably align said retainer with said tray in the same orientation.

6. A two-piece plastic holder for loosely holding a plurality of microtiter sample tubes of a preselected design, comprising a) a one-piece tray comprising i) a flat, horizontal rectangular tray plate section containing a first plurality of holes in an array compatible with industry standard microtiter plate format;

ii) a first vertical tray sidewall section around said plate extending upwardly, two spaced vertically extending tray sidewall slots disposed in each of two opposite ends of said tray sidewall section, an elongated horizontal tray sidewall recess disposed between each of said two spaced tray sidewall slots;

b) a one-piece rectangular retainer releasably nestable in said tray over any sample tubes resting in said tray, comprising i) a flat, horizontal retainer plate section containing a second plurality of holes in a rectangular array compatible with said first plurality of holes, ii) a first vertical retainer sidewall section around said plate extending upwardly, a U-shaped handle extending horizontally outwardly from each of two opposite ends of said retainer sidewall section corresponding to said two opposite ends of said tray sidewall sections, each of said U-shaped handles having two legs which slide into said tray slots respectively when said retainer is nested in said tray, a tab projecting horizontally outwardly from said sidewall section between each of said two legs which snap into said tray sidewall recesses respectively when said retainer is nested in said tray, said retainer plate section having elongated slots parallel to and directly adjacent said opposite ends of said retainer sidewall section respectively, whereby inwardly directed finger pressure on said U-shaped handles flex said opposite ends of said retainer sidewall sections to release said tabs from said tray sidewall recesses respectively to facilitate removal of said retainer from said tray.

7. Apparatus according to claim 6 wherein said one piece tray includes a second vertical tray sidewall section around said plate extending downward from said plate.

8. Apparatus according to claim 6 wherein said one piece retainer includes a second vertical retainer sidewall section around said plate extending downwardly from said plate.

9. Apparatus according to claim 6 wherein said sample tubes have a cylindrically shaped upper section open at its top end and a closed, tapered lower section extending downwardly therefrom, each tube being of circular cross section and having a circumferential shoulder extending outwardly from said upper section at a position on said upper section spaced from the open end thereof, said holes in said tray being slightly larger than the outside diameter of the upper section of said tubes but smaller than the outside diameter of said shoulder, said first vertical tray sidewall section having a height greater than the height of a tube resting in one of said holes, said second vertical tray sidewall section extending downwardly approximately to the bottom of the upper section of a tube resting in one of said holes;

said holes in said retainer being slightly larger than the outside diameter of the upper section of said tubes but smaller than the outside diameter of said shoulder, and wherein when said retainer is nested in said tray, the retainer plate section lies slightly above the shoulder of a tube resting in said tray and the first tray sidewall section is about as high as said retainer sidewall section, whereby tubes resting in said tray are retained loosely both vertically and laterally.

10. Apparatus according to claim 9 wherein the holes in the tray plate section and in the retainer plate section are larger in diameter than said tubes by about 0.7 mm.

11. Apparatus according to claim 10 wherein the holes in said tray sections are counter sunk and wherein the underside of the shoulders of said tubes are correspondingly tapered.

12. Apparatus according to claim 6 wherein said first plurality and said second plurality of holes comprises up to twenty- four holes for receiving up to twenty-four microliter sample tubes in said holder.

13. Apparatus according to claim 6 wherein said tray further comprises a plurality of support ribs extending along the underside of said tray plate section between rows of holes, and wherein said retainer further comprises a plurality of support ribs extending along the upperside of said retainer plate section between rows of holes.

14. Apparatus according to claim 7 further comprising a plastic base having a plurality of wells in a rectangular array compatible with said first and said second plurality of holes, said wells being dimensioned to snugly accept lower sections of said tubes; said base, said tray, said retainer and said sample tubes when assembled form a microtiter plate assembly having a footprint of an industry standard microtiter plate assembly.

15. Apparatus according to claim 7 wherein said first vertical tray sidewall section and said vertical retainer sidewall sections have mating beveled corners, thereby to repeatably align said retainer with said tray in the same orientation.

16. Apparatus according to claim 6 wherein said holder assembly is molded from reinforced polyester thermoplastic.

17. Apparatus according to claim 6 wherein said sections have a thickness of the order of about 1.27 mm.

18. A two-piece plastic holder for loosely holding a plurality of microtiter sample tubes of a preselected design, each having a cylindrically shaped upper section open at its top end and a closed, tapered lower section extending downwardly therefrom, each tube being of circular cross section and having a circumferential shoulder extending outwardly from said upper section at a position on said upper section spaced from the open end thereof, comprising a) a one-piece tray comprising i) a flat, horizontal, rectangular tray plate section containing a first plurality of holes in an array compatible with industry standard microtiter plate format, said holes being larger than the outside diameter of the upper sections of said tubes by about 0.7 mm. but smaller than the outside diameter of said shoulder, said holes being countersunk, said tray plate having a plurality of support ribs extending along the underside of the tray plate between rows of holes;

ii) a first vertical tray sidewall section around said plate extending upwardly to a height greater than the height of a tube resting in one of said holes, two-spaced vertically extending tray sidewall slots disposed in each of two opposite ends of said tray sidewall section, an elongated horizontal tray sidewall recess disposed between each of said two spaced tray sidewall slots;

iii) a second vertical tray sidewall section around said plate extending downwardly approximately to the bottom of the upper section of a tube resting in one of said holes;

b) a one-piece rectangular retainer releasably engageable inside said tray over any sample tubes resting in said tray comprising i) a flat, horizontal rectangular plate section containing a second plurality of holes in a rectangular array compatible with said first plurality of holes, said holes being larger than the outside diameter of the upper sections of said tubes by about 0.7 mm. but smaller than the outside diameter of said shoulder, said retainer plate section having a plurality of support ribs extending along the upperside of said retainer plate section between rows of holes;

ii) a first vertical retainer sidewall section around said plate extending upwardly, a U-shaped handle extending horizontally outwardly from each of two opposite ends of said retainer sidewall section corresponding to said two opposite ends of said tray sidewall sections, each of said U-shaped handles having two legs which slide into said tray slots respectively when said retainer is nested in said tray, a tab projecting horizontally outwardly from said sidewall section between each of said two legs which snaps into said tray sidewall recesses respectively when said retainer is nested in said tray, said retainer plate section having elongated slots parallel to and directly adjacent said opposite ends of said retainer sidewall sections respectively, wherein inwardly directed finger pressure on said U-shaped handle inwardly flex said opposite ends of said retainer sidewall sections to release said tabs respectively from said tray sidewall recesses respectively to facilitate removal of said retainer from said tray;

iii) a second vertical retainer sidewall section around said retainer plate section extending downwardly from said retainer plate section; and said sections being molded from reinforced polyester thermoplastic and said sections having a thickness of the order of about 1.27 mm, whereby when said retainer is nested in said tray, the retainer plate section lies slightly above the shoulder of a tube resting in said tray and the first tray sidewall section is about as high as said retainer sidewall section, so that the tubes resting in said tray are retained loosely both vertically and laterally.

19. Apparatus according to claim 18 further comprising a plastic base having a plurality of wells in a rectangular array compatible with said first and second plurality of holes, said wells being dimensioned to snugly accept lower sections of said tubes, said base being assembled with said tray and said retainer and said sample tubes to form a microtiter plate assembly having a footprint of an industry standard microtiter plate assembly.

20. Apparatus according to claim 18 wherein said vertical tray sidewall section and said vertical retainer sidewall section have mating beveled corners, thereby to align said retainer with said tray when assembled.

* * * * *